US007343842B2

(12) United States Patent
Chen

(10) Patent No.: US 7,343,842 B2
(45) Date of Patent: Mar. 18, 2008

(54) APPARATUS FOR CUTTING FILM TUBING

(75) Inventor: Kuo-Raid Grant Chen, Cary, NC (US)

(73) Assignee: Axon LLC, Raleigh, NC (US)

( * ) Notice: Subject to any disclaimer, the term of this patent is extended or adjusted under 35 U.S.C. 154(b) by 1 day.

(21) Appl. No.: 11/247,056

(22) Filed: Oct. 11, 2005

(65) Prior Publication Data

US 2006/0090624 A1 May 4, 2006

Related U.S. Application Data

(63) Continuation-in-part of application No. 10/975,893, filed on Oct. 28, 2004, now abandoned.

(51) Int. Cl.
*B26D 5/08* (2006.01)
*B65B 41/00* (2006.01)

(52) U.S. Cl. ..... 83/597; 83/607; 83/651; 83/663; 83/647.5; 83/946; 53/296; 53/389.3; 156/556

(58) Field of Classification Search ..... 83/364, 83/389.3, 597, 607, 663, 946, 639.1, 54, 83/598, 924, 370, 647.5, 602, 651; 156/556, 156/86, 353, 215, 443, 521, 517, 876, 579, 156/647.5, 924, 946; 53/290, 389.3, 64, 53/68, 585, 71, 298, 291, 296, 65, 858; 457/340, 457/331; 30/92, 97, 101
See application file for complete search history.

(56) References Cited

U.S. PATENT DOCUMENTS

| | | | | |
|---|---|---|---|---|
| 1,755,945 | A * | 4/1930 | Alexandrescu | 74/440 |
| 2,305,564 | A * | 12/1942 | Tubbs | 76/37 |
| 3,897,063 | A * | 7/1975 | Lehwalder | 273/280 |
| 4,500,180 | A * | 2/1985 | Stevens | 351/234 |
| 5,492,029 | A * | 2/1996 | Obrist | 74/409 |
| 6,829,971 | B1 * | 12/2004 | Huang et al. | 83/597 |
| 6,997,079 | B2 * | 2/2006 | Nomura et al. | 74/440 |
| 7,075,860 | B2 * | 7/2006 | Dias | 368/77 |
| 2004/0011169 | A1 * | 1/2004 | Marshall et al. | 83/13 |

* cited by examiner

*Primary Examiner*—Ghassem Alie
(74) *Attorney, Agent, or Firm*—Thompson Hine LLP

(57) ABSTRACT

The invention relates to an apparatus for cutting film tubing in a machine for applying tubular labels to each of a series of containers that are transported on a conveyor. The film tubing is advanced incrementally through a ring gear and a bore in a platform on which the ring gear is rotatably mounted. A number of pinions with attached cutting blades are rotatably mounted to the platform in positions to mesh with the ring gear. One of the pinions is driven to rotate a single revolution when the film tubing has been advanced. The driven pinion causes the additional pinions to rotate through rotation of the ring gear, causing the blades to cut the film tubing.

13 Claims, 3 Drawing Sheets

APPARATUS FOR CUTTING FILM TUBING

RELATED APPLICATION

This invention is a Continuation-In-Part of application Ser. No. 10/975,893 filed Oct. 28, 2004, now abandoned.

FIELD OF THE INVENTION

The present invention relates to the field of cutting mechanisms, and more particularly to cutting mechanisms adapted for cutting thin wall tubing in a tubular labeling machine.

BACKGROUND OF THE INVENTION

Thin wall plastic tubing is often used for over-wrapping product containers, for example bottles containing personal hygiene, pharmaceutical or food products. In one form, the plastic tubing is applied as a label over a major portion of the container to identify the product and/or enhance the appearance of the container. In another form, the plastic tubing provides a tamper-evident band that covers the container cap and neck, serving to indicate whether the container has been opened prior to purchase. Identifying labels and tamper-evident bands are referred to collectively herein as tubular labels. In many cases the plastic tubing is processed so as to be shrinkable by the application of heat after a cut length of tubing has been placed over the container causing the tubing to conform snugly to the contours of the container.

The subject plastic tubular labels are applied to product containers in manufacturing environments, therefore process reliability, tubing length consistency, and neatness of the cut edge are important factors. Most known machines for the application of thin wall plastic tubing to containers employ a scissor-type double blade cutter or a guillotine-type single blade cutter. Another cutter type operates a number of rotatably mounted blades that are positioned around a central hole through which a tubular film is passed. The blades are caused to rotate after the film has been advanced a predetermined length.

One such cutter is described in U.S. Pat. No. 5,531,858 entitled "Shrinkable Label Inserting Machine" in which the blades are mounted on a number of rotatable wheels that are in contact with a single driven band, e.g. a belt or chain, that drives all of the wheels.

A second such cutter is described in U.S. Pat. No. 5,791,220 entitled "Cutting Device Of Packing Apparatus" in which the blades are mounted on a number of rotatable wheels that are in contact with one of a series of bands that drive each wheel in tandem.

A third such cutter is described in U.S. Pat. No. 5,970,685 entitled "Cutting Mechanism For A Thermal Shrinking Film Labeling Machine" in which the blades are mounted on a number of electronic or hydraulic rotary tool holders that are adapted for rotating back and forth.

The present invention provides a unique film tubing cutter that employs a driving mechanism not disclosed in any known prior art and is described below.

The present invention cutter may also be used for cutting lengths of thin wall tubing that is formed substantially continuously by the process of extrusion. The resulting extruded tubing product is cut to defined lengths for packaging and shipping. The present invention is useful to cut lengths of tubing emerging from the extruding operation or subsequently in substitution for the current single blade cutting that is commonly used.

SUMMARY OF THE INVENTION

The apparatus for cutting film tubing described herein utilizes a number of pinions that are rotatably mounted and equally spaced around a bore in a platform. A blade is assembled to each pinion and the pinions mesh with a central ring gear that is rotatably mounted on the platform coaxially with the bore of the platform. A film tube is passed through the ring gear and the platform bore. One of the pinions is driven by a motor through a single-revolution clutch. A series of bottles, or other products on which a tubular label is to be mounted, is transported on a conveyor to a location below the platform bore. As a bottle approaches a point in line with the center of the bore, a length of film tubing is advanced and the clutch is actuated to cause the pinions to swing the blades in synchronized arcs to sever a length of tubing that is then placed on the bottle. A product conveyor is used if the cut tubing is to be placed over a bottle or other product, but not if the cutter is used for cutting lengths of tubing from an extruder.

BRIEF DESCRIPTION OF THE DRAWINGS

The present invention is best understood in conjunction with the accompanying drawing figures in which like elements are identified by similar reference numerals and wherein.

DETAILED DESCRIPTION OF THE PREFERRED EMBODIMENTS

Figure 1:
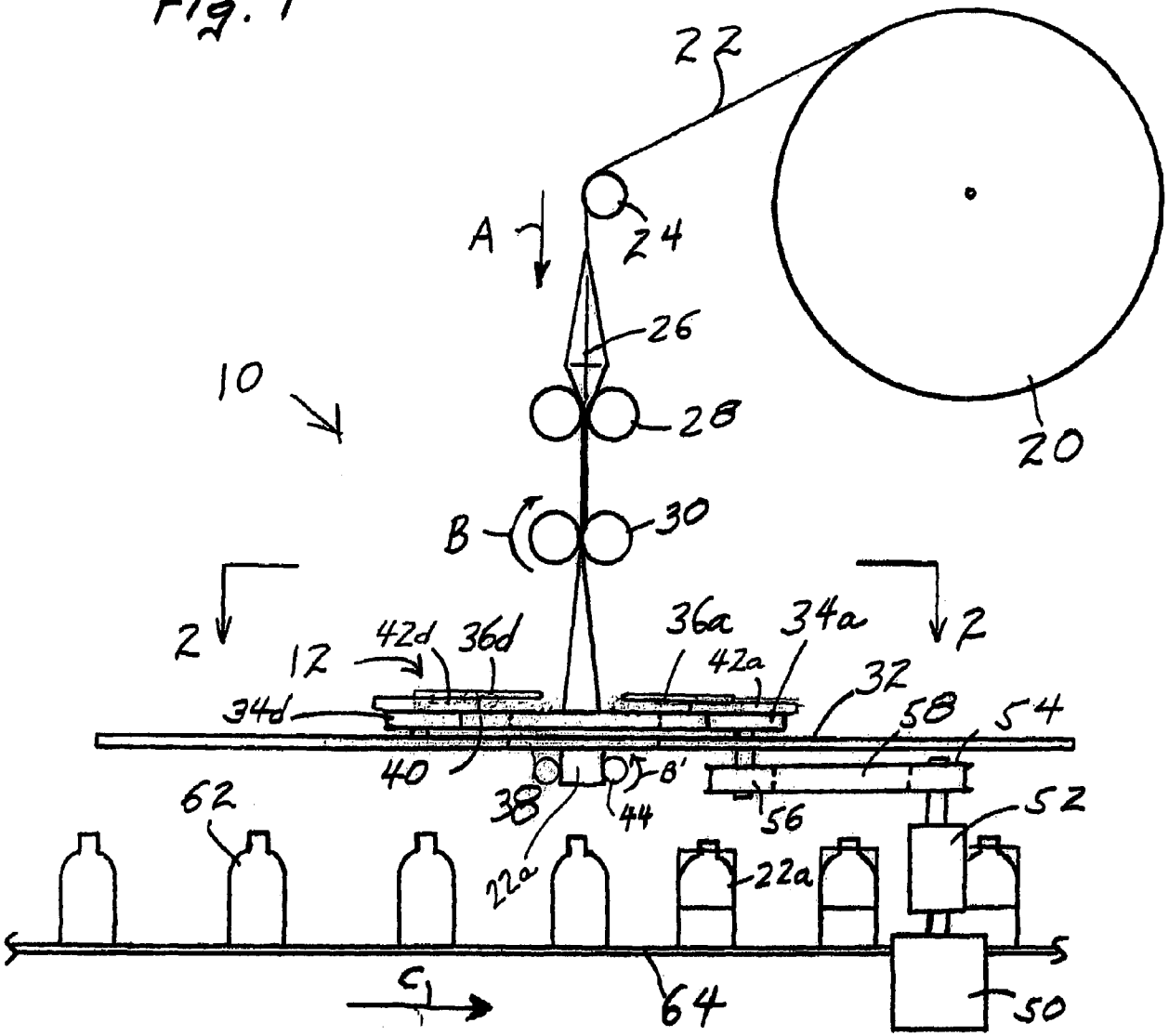
FIG. 1 is a schematic elevation view of a machine for applying tubular labels to containers transported on a conveyor including the cutting apparatus of a first embodiment of the present invention.
Figure 2:
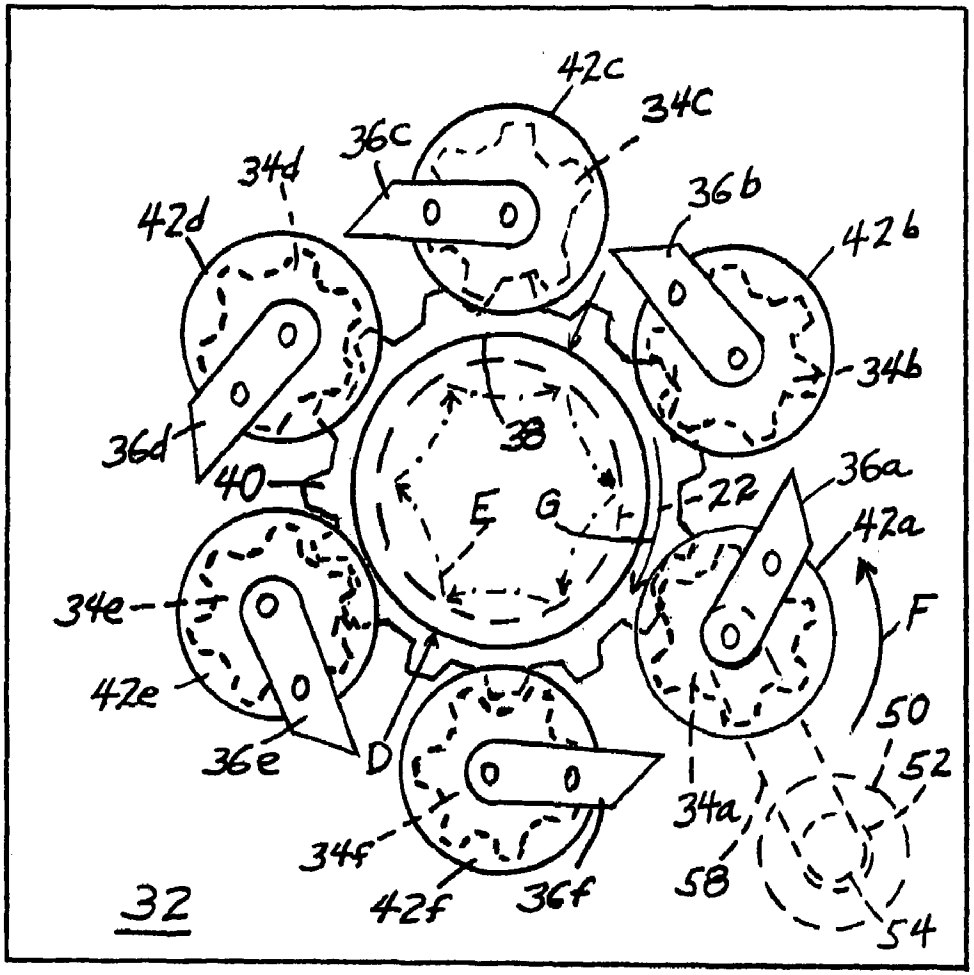
FIG. 2 is a schematic plan view of the cutting apparatus of the present invention taken in the direction of line 2-2 of FIG. 1 with the conveyor eliminated for clarity.

Referring to FIG. 1, the machine 10 for applying tubular labels or tamper-evident bands to containers 62 advances a tubular film 22 in the direction indicated by arrow A from a film supply 20 by the intermittent action of driven wheels 30 in the direction indicated by arrow B. Driven wheels 30 are rotated by an actuator (not shown), for example a stepper motor. Driven wheels 30 and idlers 24 and 28 are mounted to a support (not shown) to define a path for advancing tubular film 22 from supply 20 through a bore 38 in a platform 32. A spreader 26, as is known in the trade, is inserted into tubular film 22 between idler 24 and idlers 28 to open and cross fold tubular film 22 from the flattened condition on supply 20 to an opened condition. The apparatus 12 of the invention for cutting film tubing 22 is mounted to platform 32, and a conveyor 64 passes below platform 32 in the direction indicated by arrow C for carrying a series of spaced apart products or containers, for example bottles 62, to be labeled. Film tubing 22 is to be cut into selected length sleeves by blades 36*a* and 36*d* that are mounted respectively on pinions 34*a* and 34*d*. In practice, and as shown in FIG. 2, more than two blades and pinions are used. Pinions 34*a* and 34*d* engage a ring gear 40 that is mounted on platform 32 in concentric relation to bore 38. A set of discs 42*a* and 42*d* are assembled to pinions 34*a* and 34*d* to prevent ring gear 40 from axial movement. Film tubing 22 is first held still and then discharged by a pair of drivers 44 as each bottle 62 is positioned to receive the sleeve label. As stated above, the cutter of the present invention is applicable to cut lengths of tubing from an extruding operation, in which case the conveyor is not needed. The present invention can also be employed with film tubing 22 being advanced horizontally to enwrap a horizontally oriented product with cutting mechanism 12 oriented vertically.

Referring now to FIG. 2, platform 32 is formed with a bore 38 therethrough of sufficient diameter D to allow tubular film 22 to pass. A ring gear 40, formed with its central hole equal to or greater in diameter than bore 38 in platform 32, is mounted on platform 32 in a manner to enable free rotation thereof. A series of pinions 34*a*-34*f* are mounted rotatably to platform 32 in angularly dispersed positions around ring gear 40 to mesh therewith. Each pinion 34*a*-34*f* is assembled to a shaft, the shafts being perpendicular to the surface of platform 32. A selected number of planar members, for example discs 42*a*-42*f*, are assembled coaxially to the upper surface of each respective pinion 34*a*-34*f*. Discs 42*a*-42*f* are preferably equal to or greater than pinions 34*a*-34*f* in diameter to overlap at least the area occupied by the teeth of ring gear 40. Whereas the preferred embodiment is depicted in FIG. 2 as having 6 discs, a lesser number of discs, e.g. 3 or 4 discs, would perform the essential function of maintaining ring gear 40 in position axially. The ring formed of pinions 34*a*-34*f* effectively radially captures ring gear 40 while discs 42*a*-42*f* axially capture ring gear 40, allowing free rotation thereof while preventing significant movement in both the radial or axial directions. Depending on the materials of which pinions 34*a*-34*f* and ring gear 40 are made and on the service requirements of the cutting apparatus, a bearing washer or gasket (not shown) may be assembled between each pinion and the respective disc. According to the preferred embodiment, no mounting bearings or retention clips are employed to support or restrain ring gear 40. Ring gear 40 is rotated by the action of pinions 34*a*-34*f*. A series of blades 36*a*-36*f* are affixed to the top surfaces of each of discs 42*a*-42*f*. Blades 36*a*-36*f* are preferably formed with elongate sharp cutting edges and angled tips, as is shown. The sharp elongate edges of blades 36*a*-36*f* face the center of ring gear 40 when pinions 34*a*-34*f* are in the rest position. Blades 36*a*-36*f* are each mounted to respective discs 42*a*-42*f* with their respective elongate cutting edges similarly oriented in respect to a radius of ring gear 40 in order that blades 36*a*-36*f* are able to rotate in the same angular direction as indicated by arrow F, i.e. counterclockwise. The synchronized rotation and positioning of pinions 34*a*-34*f*, discs 42*a*-42*f* and blades 36*a*-36*f* results in the tips of blades 36*a*-36*f* following complementary, overlapping arcs as indicated by arrows E to intersect and cut tubular film 22 without interference from other blades. The preferred embodiment depicted herein has 6 pinions and 6 blades, but different numbers of pinions and blades are possible, with the pinion diameter and the blade length configured accordingly. In particular, the invention contemplates a lesser number of pinions and blades with a tubular film of smaller diameter, and vice versa. The pinions 34*a*-34*f* and discs 42*a*-42*f* are mounted an equal angular distance from each other. In order to maintain a precise orientation between the blades and the respective pinions to which they are mounted, discs 42*a*-42*f* are preferably formed with a blade seat, or channel (not shown). Blades 36*a*-36*f* are fastened into respective blade seats or anchored by fasteners for secure positioning. The invention disclosed further encompasses a configuration in which the illustrated assembly is inverted with blades 36*a*-36*f* disposed beneath discs 42*a*-42*f* and cutter mechanism 12 resides beneath platform 32.

Each pinion 34*a*-34*f* is held in a stationary rest position between tubing cutting operations, as illustrated in FIG. 2, with each respective blade 36*a*-36*f* residing substantially perpendicular to a radius of bore 38. The majority of pinions, specifically pinions 34*b*-34*f*, are mounted to be freely rotatable with respect to platform 32 in a manner well known to those skilled in the art. A selected pinion, specifically pinion 34*a*, is mounted to a shaft that passes through platform 32 to terminate at a pulley 56 (FIG. 1), preferably a timing pulley. Pulley 56 is drivingly connected by a belt 58, preferably a timing belt, to pulley 54, preferably a timing pulley. Pulley 54 is mounted to the shaft of a clutch 52 that is coupled to a motor 50. Motor 50 is of any known type of motor able to drive the mechanism described herein. Motor 50 operates continuously. Clutch 52 is of the type known as a single-revolution clutch/brake, available for example from Danaher Corporation of Washington, D.C. The size and power ratings of motor 50 and clutch 52 are to be determined according to the requirements of the system being designed.

Referring again to FIG. 1, conveyor 64 operates continuously to convey a series of bottles 62 into position below the center of bore 38 in plate 32. As each bottle 62 approaches the desired position, a selected length of tubular film 22 is advanced by driven wheels 30 and is positioned above the projected location of container 62. Clutch 52 is activated by motor 50 to rotate through one revolution, causing pinion 34*a* to rotate one revolution, in turn causing pinions 34*b*-34*f* (FIG. 2) to rotate one revolution through the counter rotation of ring gear 40 in the direction indicated by arrow G. Blades 36*a*-36*f* are caused to rotate in unison through arcs E (shown in dashed lines) to cut through tubular film 22, separating the advanced length of tubing from tubular film 22 as a cut sleeve. A pair of film drivers 44 (FIG. 1) reside downstream of blades 36*a*-36*f* to hold each cut length of tubing film 22 suspended until a bottle 62 is properly positioned. Sensors (not shown) to detect the continuity of tubular film 22 and the position of bottles 62 are provided in the manner known in the trade. The sensors send responsive signals to a microprocessor (not shown) for control of the activation timing of driven wheels 30, drivers 44 and clutch 52. The cut sleeve 22*a* is first held stationary and then discharged by drivers 44 when bottle 62 reaches the selected position. The cut lengths of tubular film 22 are illustrated as sleeves 22*a* on bottles 62 that have been conveyed past the label mounting position. After clutch 52 causes blades 36*a*-36*f* to cut tubular film 22, drivers 44 are activated to discharge the cut sleeve 22*a* onto bottle 62 and, simultaneously, driven wheels 30 are activated to advance a subsequent length of tubular film 22. Subsequent to assembling the cut sleeves 22*a* on bottles 62, bottles 62 are placed into an environment to cause the sleeves to shrink radially and snugly enwrap the bottles, for example a heat tunnel.

Figure 3:
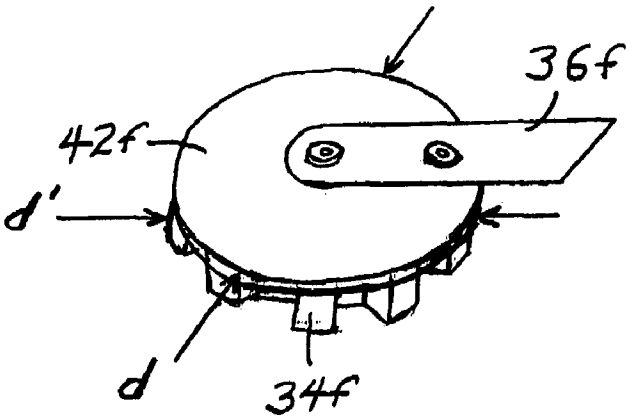
FIG. 3 is a perspective view of a pinion with a disc and a blade assembled thereto according to a first embodiment of the invention.

Referring now to FIG. 3, a perspective view of a typical pinion 34*f* is shown with disc 42*f* and blade 36*f* mounted thereto. As briefly described above, the diameter d of disc 42*f* is equal to or greater than the diameter d' of pinion 36*f*. This diameter d provides that the gaps between the teeth of pinion 34*f* are covered by disc 42*f*. When assembled as shown in FIG. 2, the teeth of ring gear 40 engage the teeth of pinion 34*f* and are covered by the extending portion of disc 42*f*. In this matter, disc 42*f* and additional discs mounted to several pinions axially capture ring gear 40 in close proximity to platform 32.

Figure 4:
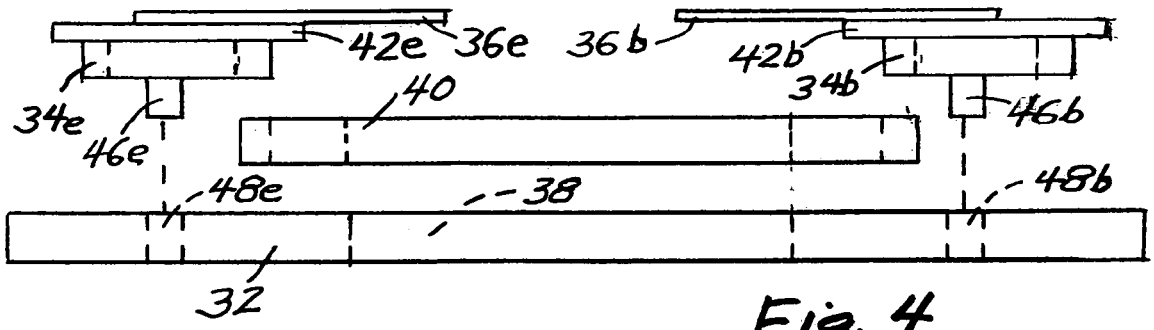
FIG. 4 is an exploded schematic elevation view of the cutting apparatus according to the first embodiment.

Referring now to FIG. 4, the embodiment illustrated and described in relation to FIGS. 1, 2 and 3 is shown in partially exploded schematic side elevation view. As described above in relation to FIG. 3, a planar member, e.g. disc 42*e* is mounted by any appropriate means to pinion 34*e*, and blade 36*e* is mounted by appropriate means to disc 42*e*. A shaft 46*e* extends axially outward from the bore of pinion 34*e* for mounting into socket 48*e* in platform 32 to enable pinion 34*e* to rotate freely. A similar set of components 34*b*, 36*b*, 42*b*, 48*b* is shown in mirror image. Ring gear 40 is positioned to reside rotatably on platform 32 in coaxial alignment to bore 38. As described briefly above, when the cutting apparatus of the invention is fully assembled, with shaft 46*e* positioned in socket 48*e*, the teeth of pinions 34*e*, 34*b* engage the teeth of ring gear 40, and discs 42*e*, 42*b* prevent ring gear 40 from more than slight axial movement. As will be understood, the spacing of disc 42*e* from platform 32 controls the degree of axial movement possible by ring gear 40. While the cutting assembly is illustrated with blades 36*e*, 36*b* above platform 32, the invention contemplates mounting the apparatus in reverse vertical positions so that blades 36*e*, 36*b* are below platform 32, depending on the needs of the operation for which it is used.

Figure 5:
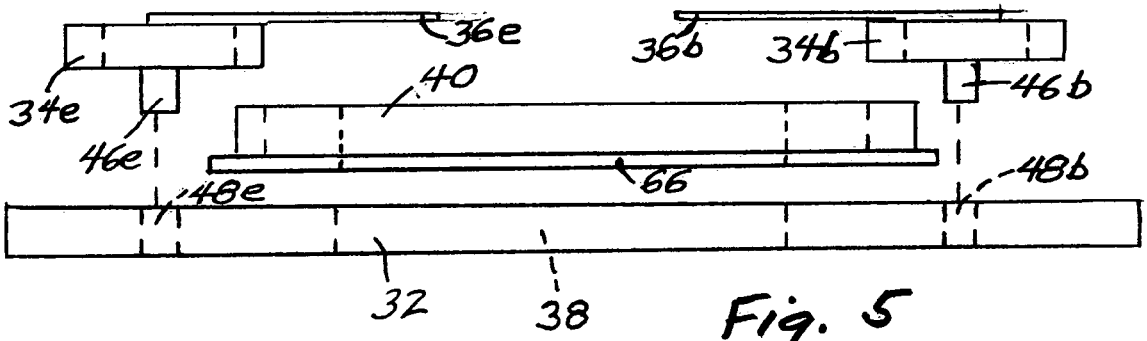
FIG. 5 is an exploded schematic elevation view of the cutting apparatus according to a second embodiment of the invention.

Referring now to FIG. 5, a partial exploded schematic elevation view of a second preferred embodiment of the invention is shown. Blade 36*e* is assembled directly to the upper surface of pinion 34*e* with no intervening planar member. Ring gear 40 is assembled coaxially to an annular planar member, e.g. washer plate 66, being formed with a central bore therethrough of similar diameter to the bore through ring gear 40. Ring gear 40 is assembled to washer plate 66 by any appropriate means. Upon assembly, with the teeth of pinions 34*e*, 34*b* engaged with the teeth of ring gear 40, and shafts 46*e*, 46*b* held in sockets 48*e*, 48*b*, portions of pinions 34*e*, 34*b* overlap the perimeter of washer disc 66 and prevent ring gear 40 from more than slight upward axial movement.

Figure 6:
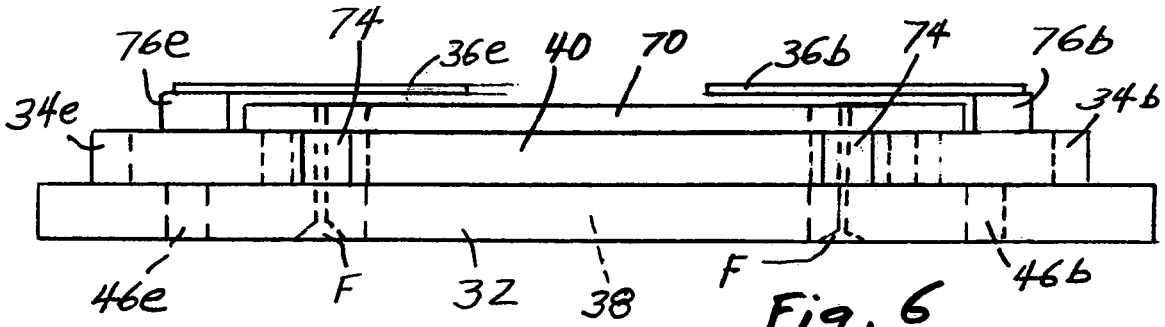
FIG. 6 is an assembled schematic elevation view of the cutting apparatus according to a third embodiment of the invention.

Referring now to FIG. 6, a third preferred embodiment is shown in assembled side elevation view. An annular planar member, e.g. washer plate 70, formed with a central bore of similar diameter to the bore of ring gear 40, is mounted to platform 32 by fasteners F or other means passing through a series of supports 74. Supports 74 are of sufficient length to allow ring gear 40 to rotate freely and not move more than a slight amount in the axial direction. Supports 74 are positioned in locations on platform 32 to avoid interfering with pinions 34*e*, 34*b* and additional pinions as may be employed. Washer plate 70 is preferably round and of sufficient diameter to overlie an area where the teeth of ring gear 40 engage the teeth of pinions 34*e*, 34*b* to prevent more than minimal axial movement of ring gear 40. A series of blades 36*e*, 36*b* are mounted to respective pinions 34*e*, 34*b* through columns 76*e*, 76*b* so that blades 36*e*, 36*b* are able to rotate without interfering with washer plate 70.

While the description above discloses preferred embodiments of the present invention, it is contemplated that numerous variations and modifications of the invention are possible and are considered to be within the scope of the claims that follow.

What is claimed is:

1. In a machine for applying cut lengths of film tubing as tubular labels to products, an apparatus for cutting the film tubing, comprising:

a. a platform having a bore formed therethrough;

b. a ring gear having external teeth and a hole formed centrally therethrough positioned on the platform coaxially with the bore, wherein the film tubing is passed through the ring gear;

c. a plurality of pinions rotatably mounted to the platform in positions to engage the teeth of the ring gear, the plurality of pinions arranged about a periphery of the ring gear;

d. a planar member is mounted to the pinions to overlie an area of the ring gear, the area being located between the associated pinion and the bore formed through the platform and spaced radially from the hole formed centrally through the ring gear, the planar member located in proximity to the ring gear to capture the ring gear between the platform and the planar member thereby limiting movement of the ring gear in the axial direction away from the platform by contacting the ring gear;

e. a blade affixed to each of the plurality of pinions; and f. means for rotating one of the pinions.

2. The apparatus for cutting as described in claim 1, wherein the planar member comprises a disc fixedly mounted to each of more than one of the plurality of pinions.

3. The apparatus for cutting as described in claim 2, wherein the more than one of the plurality of pinions comprises three or more pinions.

4. The apparatus for cutting as described in claim 2, wherein the more than one of the plurality of pinions comprises all the pinions.

5. The apparatus for cutting as described in claim 2, wherein each of the discs is equal to or greater in diameter than a diameter of the pinions.

6. The apparatus for cutting as described in claim 1, wherein the means for rotating one of the pinions comprises means for causing the one pinion to rotate one revolution.

7. The apparatus for cutting as described in claim 6, wherein the means for causing the one pinion to rotate one revolution comprises a single-revolution clutch in driving relation with the one pinion and coupled to a continuously operating motor.

8. The apparatus for cutting as described in claim 1, wherein the hole formed in the ring gear and the bore formed in the platform are substantially equal in diameter.

9. The apparatus for cutting as described in claim 7, further comprising a pulley assembled to the one pinion and a pulley assembled to the clutch and a belt connecting between the pinion pulley and the clutch pulley.

10. The apparatus for cutting as described in claim 9, wherein the belt is a timing belt and the pulleys are timing pulleys.

11. An apparatus for cutting a tube of film, comprising:

a platform having a bore formed therethrough;

a ring gear having external teeth and a hole formed centrally therethrough positioned on the platform coaxially with the bore, wherein the film tubing is passed through the ring gear;

a plurality of pinions rotatably mounted to the platform in positions to engage the teeth of the ring gear;

a planar member fixed to the associated pinion such that it rotates therewith, the planar member assembled to overlie an area of the ring gear, the area being located between the associated pinion and the bore formed through the platform;

a blade affixed to each of the plurality of pinions and arranged to cut the tube of film as the plurality of pinions rotate; and an actuator for rotating one of the pinions;

wherein the plurality of pinions are arranged about a periphery of the ring gear such that the plurality of pinions maintain the coaxial alignment between the hole of the ring gear and the bore of the platform by inhibiting movement of the ring gear in a direction away from a center of the bore as the ring gear rotates.

12. The apparatus of claim 11, wherein the area of overlie is spaced radially from the hole formed centrally through the ring gear.

13. The apparatus of claim 1 or 11, wherein an extent of the area of overlie terminates at a location spaced from the hole formed centrally through the ring gear.

* * * * *